US009898962B2

(12) United States Patent
Yang et al.

(10) Patent No.: US 9,898,962 B2
(45) Date of Patent: Feb. 20, 2018

(54) ORGANIC LIGHT EMITTING DISPLAY DEVICE

(71) Applicant: LG Display Co., Ltd., Seoul (KR)

(72) Inventors: JunHyeok Yang, Gyeonggi-do (KR); ChulWon Lee, Seoul (KR); Juyoung Noh, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 2 days.

(21) Appl. No.: 14/962,143

(22) Filed: Dec. 8, 2015

(65) Prior Publication Data

US 2016/0163265 A1 Jun. 9, 2016

(30) Foreign Application Priority Data

Dec. 9, 2014 (KR) ..... 10-2014-0175443

(51) Int. Cl.
*G09G 3/32* (2016.01)
*G09G 3/3233* (2016.01)

(52) U.S. Cl.
CPC ..... *G09G 3/3233* (2013.01); *G09G 2320/029* (2013.01); *G09G 2320/0233* (2013.01); *G09G 2320/043* (2013.01)

(58) Field of Classification Search
CPC ... G09G 2320/0257; G09G 2320/0252; G09G 2320/0233; G09G 2320/043–2320/048; G09G 2300/08; G09G 2300/0814; G09G 2300/0819; G09G 2300/0842; G09G 2300/043; G09G 2310/0251; G09G 2310/0272; G09G 2310/061; G09G 3/30; G09G 3/32; G09G 3/3208; G09G 3/3225;
(Continued)

(56) References Cited

U.S. PATENT DOCUMENTS 8,558,825 B2 10/2013 Bae et al.
9,236,011 B2 1/2016 Mizukoshi
(Continued)

FOREIGN PATENT DOCUMENTS

CN 102074189 A 5/2011
CN 102750055 A 10/2012
(Continued)

OTHER PUBLICATIONS

Chinese Office Action dated Sep. 26, 2017 for the counterpart Chinese Patent Application No. 201510802456.4.

*Primary Examiner* — Priyank Shah
(74) *Attorney, Agent, or Firm* — Morgan, Lewis & Bockius LLP

(57) ABSTRACT

An organic light emitting display device is disclosed, which may increase sensing accuracy by solving a problem that a difference between sensing data output from sensing units is generated due to a difference in sensing capability between the sensing units. The organic light emitting display device includes a display panel including data lines, scan lines, sensing lines, and pixels connected to the data lines, the scan lines and the sensing lines; a sensing data output unit outputting first sensing data by sensing currents flowing to the sensing lines; a scan driver supplying scan signals to the scan lines; and a source drive integrated circuit (IC) including a data voltage supply unit supplying data voltages to the data lines and a switching unit connecting the sensing lines to the sensing data output unit in a predetermined order.

21 Claims, 8 Drawing Sheets

(58) Field of Classification Search
CPC .... G09G 3/3233; G09G 3/325; G09G 3/3258; G09G 3/3283; G09G 3/3291
See application file for complete search history.

(56) References Cited

U.S. PATENT DOCUMENTS

| | | | | |
|---|---|---|---|---|
| 9,367,168 | B2 | 6/2016 | Ahn et al. | |
| 9,424,770 | B2 | 8/2016 | Kim et al. | |
| 2011/0007067 | A1* | 1/2011 | Ryu | G09G 3/3233 345/214 |
| 2011/0122119 | A1 | 5/2011 | Bae et al. | |
| 2011/0227505 | A1* | 9/2011 | Park | H05B 33/0896 315/297 |
| 2012/0262411 | A1 | 10/2012 | Ahn et al. | |
| 2013/0050292 | A1 | 2/2013 | Mizukoshi | |
| 2013/0300690 | A1 | 11/2013 | Yang et al. | |
| 2014/0009216 | A1 | 1/2014 | Jo et al. | |
| 2014/0152642 | A1* | 6/2014 | Kim | G09G 3/3233 345/212 |
| 2014/0285407 | A1* | 9/2014 | Chaji | G09G 3/3233 345/76 |
| 2014/0347253 | A1* | 11/2014 | Lee | H05B 33/0896 345/76 |
| 2014/0347332 | A1* | 11/2014 | Lee | G09G 3/3233 345/204 |
| 2015/0138179 | A1* | 5/2015 | Park | G09G 3/3233 345/212 |
| 2015/0154908 | A1* | 6/2015 | Nam | G09G 3/3233 345/76 |
| 2015/0213757 | A1* | 7/2015 | Takahama | G09G 3/3291 345/691 |
| 2016/0055791 | A1* | 2/2016 | Kishi | G09G 3/3241 345/212 |
| 2016/0086539 | A1 | 3/2016 | Mizukoshi | |
| 2016/0086548 | A1* | 3/2016 | Maeyama | G09G 3/3258 345/690 |
| 2016/0104422 | A1* | 4/2016 | Kishi | G09G 3/3233 345/205 |
| 2016/0111044 | A1* | 4/2016 | Kishi | G09G 3/3233 345/690 |
| 2016/0148578 | A1* | 5/2016 | Kishi | G09G 3/3233 345/212 |

FOREIGN PATENT DOCUMENTS

| | | |
|---|---|---|
| CN | 102968954 A | 3/2013 |
| CN | 103854602 A | 6/2014 |

* cited by examiner

ORGANIC LIGHT EMITTING DISPLAY DEVICE

CROSS REFERENCE TO RELATED APPLICATIONS

This application claims the benefit of the Korean Patent Application No. 10-2014-0175443 filed on Dec. 9, 2014, which is hereby incorporated by reference for all purposes as if fully set forth herein.

BACKGROUND OF THE INVENTION

Field of the Invention

The present invention relates to an organic light emitting display device.

Discussion of the Related Art

A touch screen has been used, which may allow a user to directly input information on a screen by using a finger or pen instead of a mouse or keyboard, which has been used as an input device of a flat panel display device, or a key pad used as an input device of portable electronic equipment. The touch screen has an advantage in that anyone may easily manipulate it, and thus its application has been increased.

With the development of information society, various demands for display devices for displaying picture images have been increased. In this respect, various display devices such as a liquid crystal display (LCD), a plasma display panel (PDP), and an organic light emitting display (OLED) device have been recently used.

The organic light emitting display device of the various display devices may be driven at a low voltage, and is characterized in a thin profile, an excellent viewing angle, and a fast response speed. The organic light emitting display device includes data lines, scan lines, a display panel having a plurality of pixels formed at crossing portions between the data lines and the scan lines, a scan driver supplying scan signals to the scan lines, and a data driver supplying data voltages to the data lines. Each of the pixels includes an organic light emitting diode, a driving transistor controlling the amount of a current supplied to the organic light emitting diode in accordance with a voltage of a gate electrode, and a scan transistor supplying the data voltages of the data lines to the gate electrode of the driving transistor in response to the scan signals of the scan lines.

A threshold voltage and mobility of the driving transistor may be varied per pixel due to process deviation during manufacture of the organic light emitting display device or a threshold voltage shift of the driving transistor, which is caused by long time driving. If the same data voltage is applied to the pixels, the same current Ids of the driving transistor should be supplied to the organic light emitting diode. However, even though the same data voltage is applied to the pixels, the current Ids of the driving transistor, which is supplied to the organic light emitting diode, is varied per pixel due to a difference in a threshold voltage and mobility of the driving transistor between the respective pixels. As a result, even though the same data voltage is applied to the pixels, a problem occurs in that luminance emitted by the organic light emitting diode is varied per pixel. To solve the problem, a method for compensating for a threshold voltage and mobility of a driving transistor has been suggested.

The method is categorized into an internal compensation method and an external compensation method. The internal compensation method refers to compensate for the threshold voltage of the driving transistor by sensing the threshold voltage within the pixel. In more detail, the internal compensation method supplies a predetermined data voltage to the pixel, senses the current Ids of the driving transistor of the pixel through a predetermined sensing line in accordance with the predetermined data voltage, converts the sensed current to digital data, and compensate for digital video data, which will be supplied to the pixel, by using the sensed digital data.

If the organic light emitting display device compensates for a threshold voltage and mobility of a driving transistor of each of pixels in accordance with the external compensation method, the organic light emitting display device includes sensing units for sensing a current Ids of the driving transistor of each of the pixels by converting the current Ids to digital data. However, even though the same current Ids of the driving transistor is sensed by the sensing units, a problem occurs in that a difference between sensing data output from the sensing units is generated due to a difference in sensing capability between the sensing units. For this reason, a problem occurs in that sensing accuracy is lowered.

SUMMARY OF THE INVENTION

Accordingly, the present invention is directed to an organic light emitting display device that substantially obviates one or more problems due to limitations and disadvantages of the related art.

An object of the present invention is to provide an organic light emitting display device that may increase sensing accuracy by solving a problem that a difference between sensing data output from sensing units is generated due to a difference in sensing capability between the sensing units.

Additional features and advantages of the invention will be set forth the description which follows, and in part will be apparent from the description, or may be learned by practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting display device comprises a display panel including data lines, scan lines, sensing lines, and pixels connected to the data lines, the scan lines and the sensing lines; a sensing data output unit outputting first sensing data by sensing currents flowing to the sensing lines; a scan driver supplying scan signals to the scan lines; and a source drive integrated circuit (IC) including a data voltage supply unit supplying data voltages to the data lines and a switching unit connecting the sensing lines to the sensing data output unit in a predetermined order.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

The same reference numbers substantially mean the same elements through the specification.

Hereinafter, the preferred embodiments according to the present invention will be described in detail with reference to the accompanying drawings. Wherever possible, the same reference numbers will be used throughout the drawings to refer to the same or like parts. Also, in the following description of the present invention, if detailed description of elements or functions known in respect of the present invention is determined to make the subject matter of the present invention unnecessarily obscure, the detailed description will be omitted. Names of elements which are used in the following description are selected considering easiness in drafting of the specification, and may be different from those of the actual product.

Figure 1:
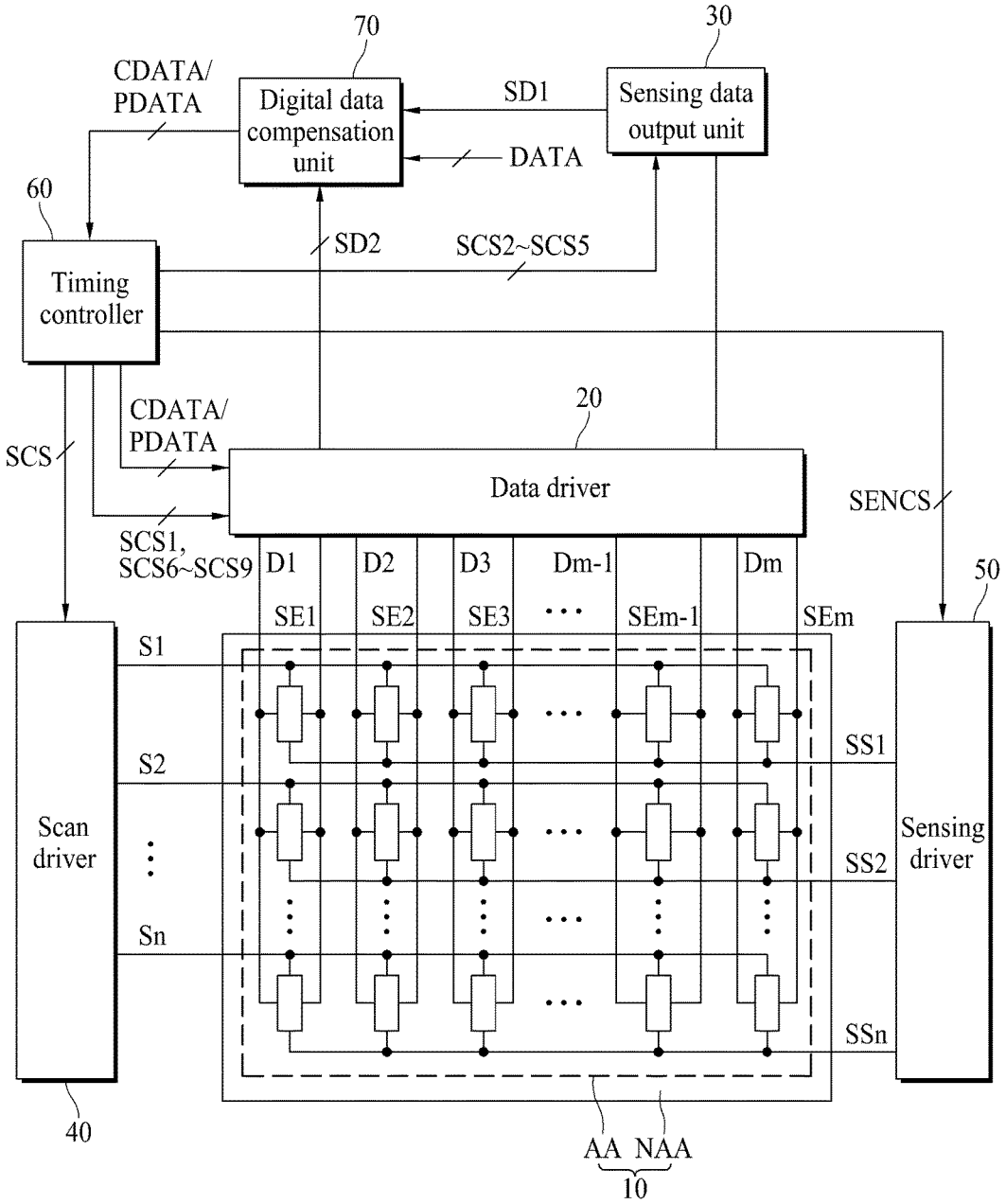
FIG. 1 is a block diagram illustrating an organic light emitting display device according to an example embodiment of the present invention.
Figure 2:
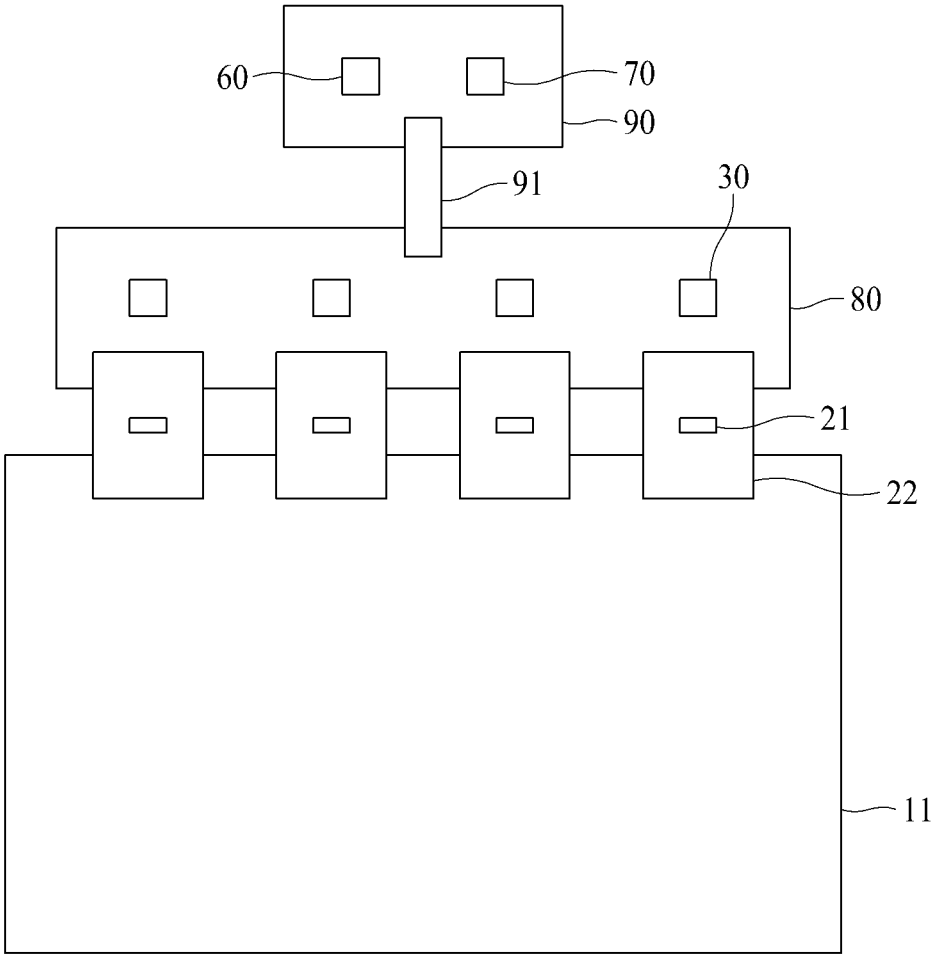
FIG. 2 illustrates a lower substrate, source drive ICs, a sensing data output unit, a timing controller, and a digital data compensation unit of a display panel of FIG. 1, flexible circuits, a source circuit board, a flexible cable, and a control circuit board.
Figure 3:
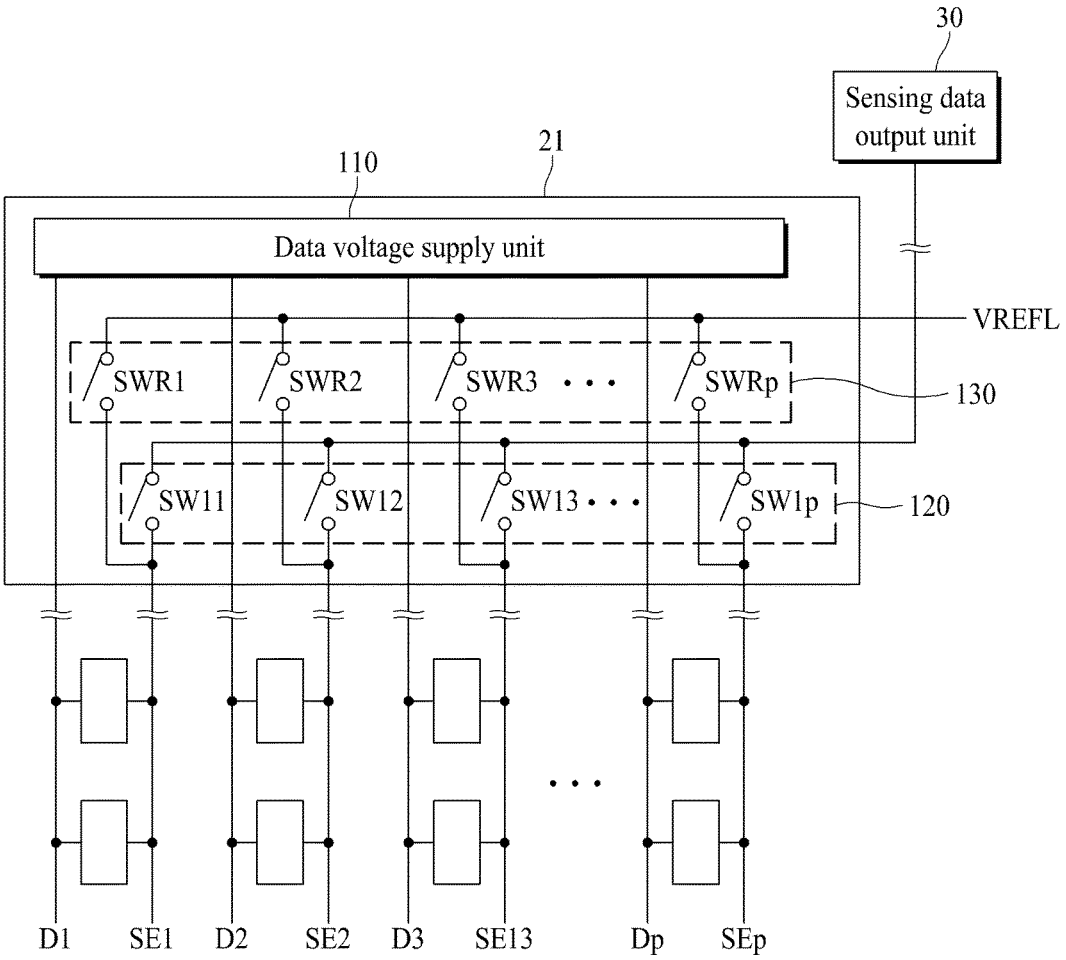
FIG. 3 is a detailed block diagram illustrating a source drive IC of FIG. 2.

FIG. 1 is a block diagram illustrating an organic light emitting display device according to an example embodiment of the present invention. FIG. 2 illustrates a lower substrate, source drive ICs, a sensing data output unit, a timing controller, and a digital data compensation unit of a display panel of FIG. 1, flexible circuits, a source circuit board, a flexible cable, and a control circuit board. FIG. 3 is a detailed block diagram illustrating a source drive IC of FIG. 2.

With reference to FIGS. 1 to 3, the organic light emitting display device according to the embodiment of the present invention includes a display panel 10, a data driver 20, flexible films 22, a sensing data output unit 30, a scan driver 40, a sensing driver 50, a timing controller 60, a digital data compensation unit 70, a source circuit board 80, a control circuit board 90, and a flexible cable 91.

The display panel 10 includes a display area AA and a non-display area NAA provided in the periphery of the display area AA. The display area AA is an area that is provided with pixels P to display an image. On the display panel 10, data lines D1 to Dm (m is a positive integer of 2 or more), sensing lines SE1 to SEm, scan lines S1 to Sn (n is a positive integer of 2 or more), and sensing signal lines SS1 to SSn are provided. The data lines D1 to Dm and the sensing lines SE1 to SEm may be formed to cross the scan lines S1 to Sn and the sensing signal lines SS1 to SSn. The data lines D1 to Dm may be formed in parallel with the sensing lines SE1 to SEm. The scan lines S1 to Sn may be formed in parallel with the sensing signal lines SS1 to SSn.

Each of the pixels P of the display panel 10 may be connected to any one of the data lines D1 to Dm, any one of the sensing lines SE1 to SEm, any one of the scan lines S1 to Sn, and any one of the sensing signal lines SS1 to SSn. Each of the pixels P of the display panel 10 may include an organic light emitting diode (OLED) and a pixel driver PD supplying a current to the organic light emitting diode (OLED) as shown in FIG. 4.

Figure 4:
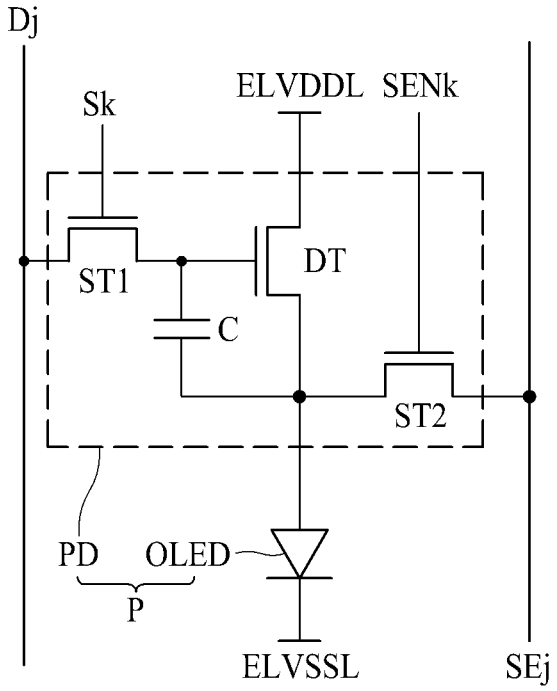
FIG. 4 is a detailed circuit diagram illustrating a pixel of FIG. 1.

The pixel driver PD may include a driving transistor DT, a first transistor ST1 controlled by the scan signals of the scan lines, a second transistor ST2 controlled by sensing signals of the sensing signal lines, and a capacitor C, as shown in FIG. 4. The pixel driver PD is supplied with luminescence data voltages of the data lines connected to the pixels P when the scan signals are supplied from the scan lines connected to the pixels P in a display mode, and supplies a current of the driving transistor DT to the organic light emitting diode OLED in accordance with the luminescence data voltages. The pixel driver PD is supplied with sensing data voltages of the data lines connected to the pixels P when the scan signals are supplied from the scan lines connected to the pixels P in a sensing mode, and supplies the current of the driving transistor DT to the sensing lines connected to the pixels P. A detailed description of the pixels P will be described later with reference to FIG. 4.

The data driver 20 includes a plurality of source drive integrated circuits (IC) 21 as shown in FIG. 2. Each of the source drives IC 21 may be packaged in each of the flexible films 22. Each of the flexible films 22 may be a tape carrier package or a chip on film. The chip on film may include a base film such as polyimide and a plurality of conductive lead lines provided on the base film. Each of the flexible films 22 may be curved or bent. Each of the flexible films 22 may be attached to the lower substrate 11 and the source circuit board 80. Particularly, each of the flexible films 22 may be attached to the lower substrate 11 in a tape automated bonding (TAB) manner by using an anisotropic conductive film, whereby the source drive ICs 21 may be connected to the data lines D1 to Dm.

Each of the source drive ICs 21 may include a data voltage supply unit 110, a switching unit 120, and an initialization voltage supply unit 130 as shown in FIG. 3. In FIG. 3, for convenience of description, the data voltage supply unit 110 is connected to p (p is a positive integer that satisfies $1 \leq p \leq m$) number of data lines D1 to Dp, and the switching unit 120 and the initialization voltage supply unit 130 are connected to p number of sensing lines SE1 to SEp.

The data voltage supply unit 110 is connected to the data lines D1 to Dp and supplies the data voltages. The data voltage supply unit 110 receives compensated data CDATA or predetermined data PDATA and a data timing control signal DCS from the timing controller 60. The data voltage supply unit 110 converts the compensated data CDATA to luminescence data voltages in accordance with the data timing control signal DCS in the display mode and then supplies the converted data voltages to the data lines D1 to Dp. The luminescence data voltage is to allow the organic light emitting diode OLED of the pixel P to emit light at a predetermined luminance. If the compensated data CDATA supplied to the data driver 20 are 8 bits, the luminescence data voltage may be supplied as any one of 256 voltages. The data voltage supply unit 110 converts predetermined data PDATA to a sensing data voltage in accordance with the data timing control signal DCS and then supplies the converted sensing data voltage to the data lines D1 to Dp. The sensing data voltage is to sense the current of the driving transistor DT of the pixel P.

The switching unit 120 is connected to the sensing lines SE1 to SEp and the sensing data output unit 30. The switching unit 120 connects the sensing lines SE1 to SEp to the sensing data output unit 30 in a predetermined order. For example, the predetermined order may be a sequential order, and in this case, the switching unit 120 may connect the sensing data output unit 30 to the first sensing line SE1 to the pth sensing line SEp sequentially.

Figure 5:
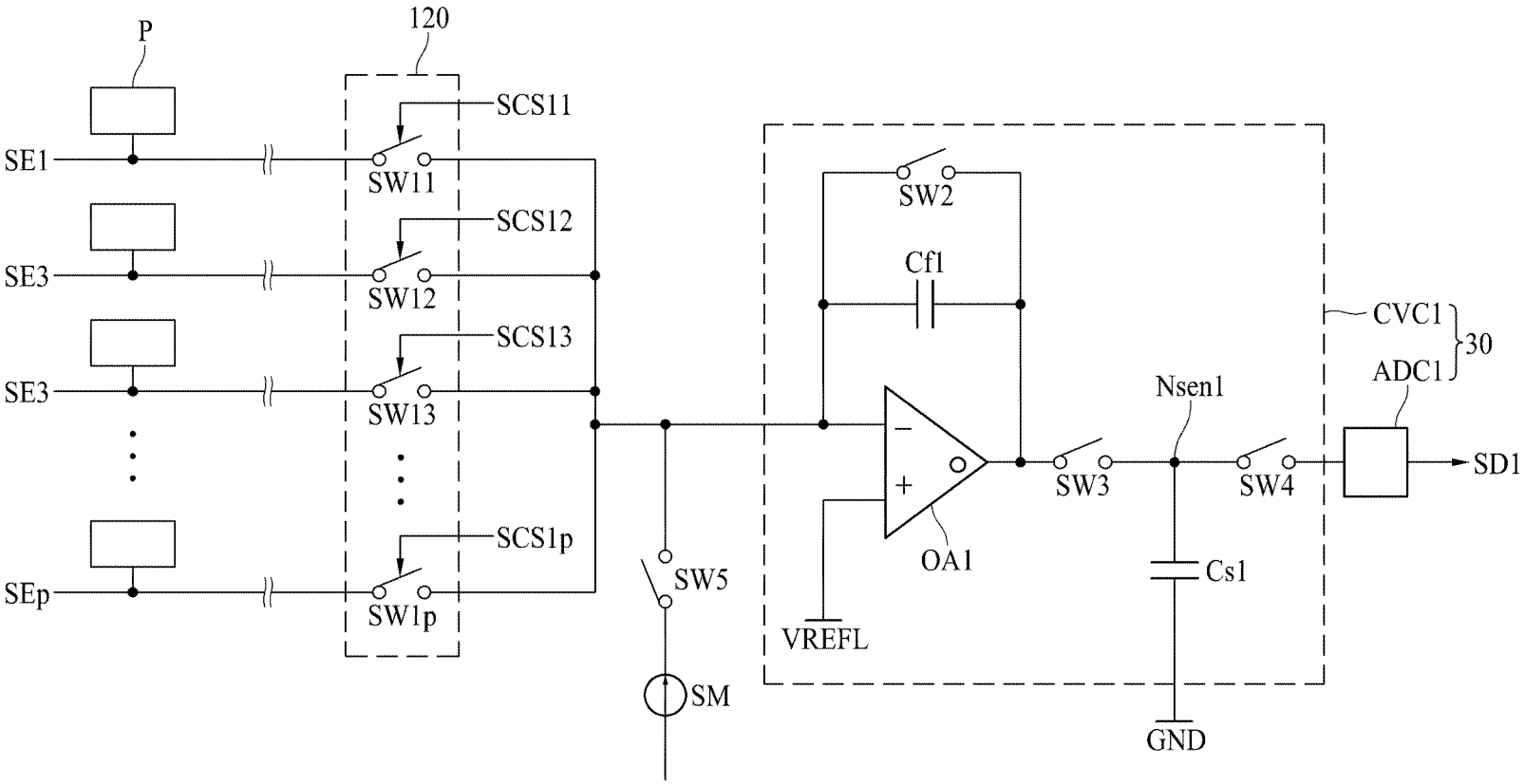
FIG. 5 is a detailed circuit diagram illustrating a switching unit and a sensing data output unit of FIG. 3.
Figure 6:
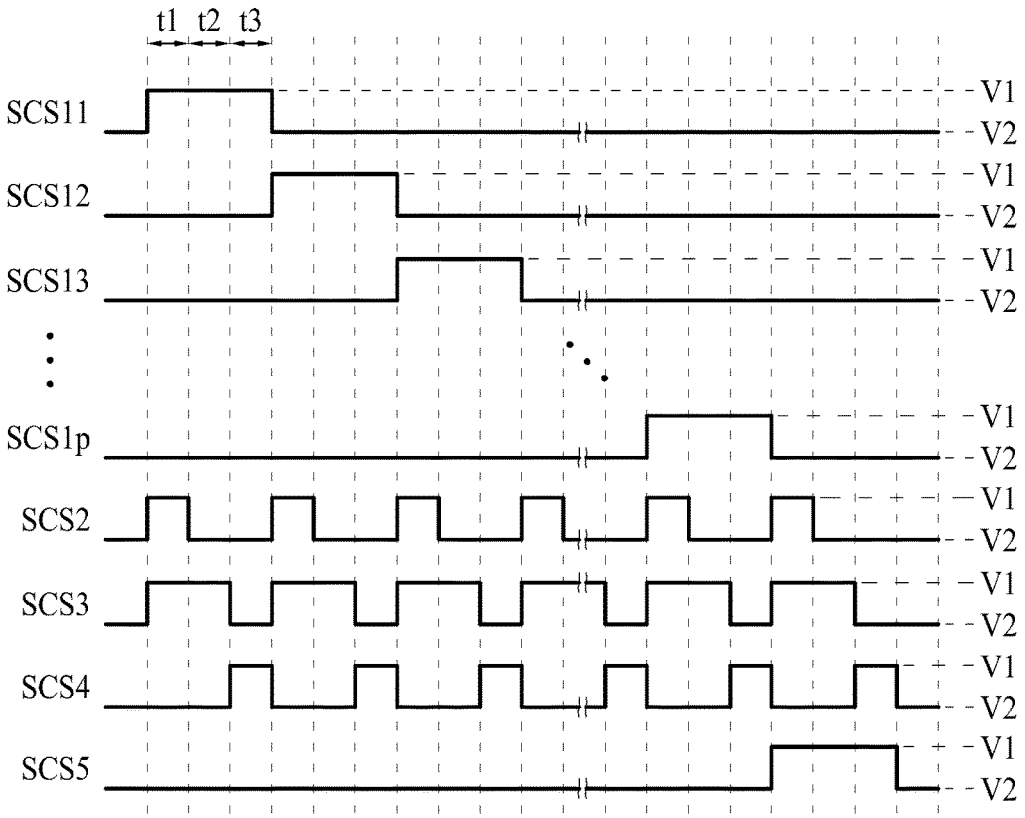
FIG. 6 is a waveform illustrating first switch signals supplied to first switches of FIG. 5 and second to fifth switch signals supplied to second to fifth switches of FIG. 5.

The switching unit 120 may include first switches SW11 to SW1*p* connected to the sensing lines SE1 to SEp as shown in FIG. 3. In this case, the switching unit 120 may connect the sensing lines SE1 to SEp to the sensing data output unit 30 in a predetermined order by switching the first switches SW11 to SW1*p* by means of first switch signals SCS1 input from the timing controller 60. Each of the first switches SW11 to SW1*p* receives the first switch signals SCS1 different from one another as shown in FIG. 6. A detailed description of the switching unit 120 will be described later with reference to FIGS. 5 and 7.

The initialization voltage supply unit 130 is connected to the sensing lines SE1 to SEp and supplies an initialization voltage. The initialization voltage supply unit 130 may include initialization switches SWR1 to SWRp as shown in FIG. 3. In this case, the initialization voltage supply unit 130 may connect the sensing lines SE1 to SEp to an initialization voltage line VREFL to which the initialization voltage is supplied, by switching the initialization switches SWR1 to SWRp by means of an initialization signal RS input from the timing controller 60. The same initialization signal RS is input to the initialization switches SWR1 to SWRp.

The sensing data output unit 30 may be provided in the source circuit board 80 as shown in FIG. 2. The source circuit board 80 may be attached to the flexible films 22, and may be connected to the control circuit board 90 by the flexible cable 91. The source circuit board 80 may be a printed circuit board.

As shown in FIG. 2, a plurality of sensing data output units 30 may be provided in the source circuit board 80. In this case, the number of sensing data output units 30 may be the same as the number of source drive ICs 21. Each of the plurality of sensing data output units 30 may be connected to each of the source drive ICs 21 one to one.

Figure 7:
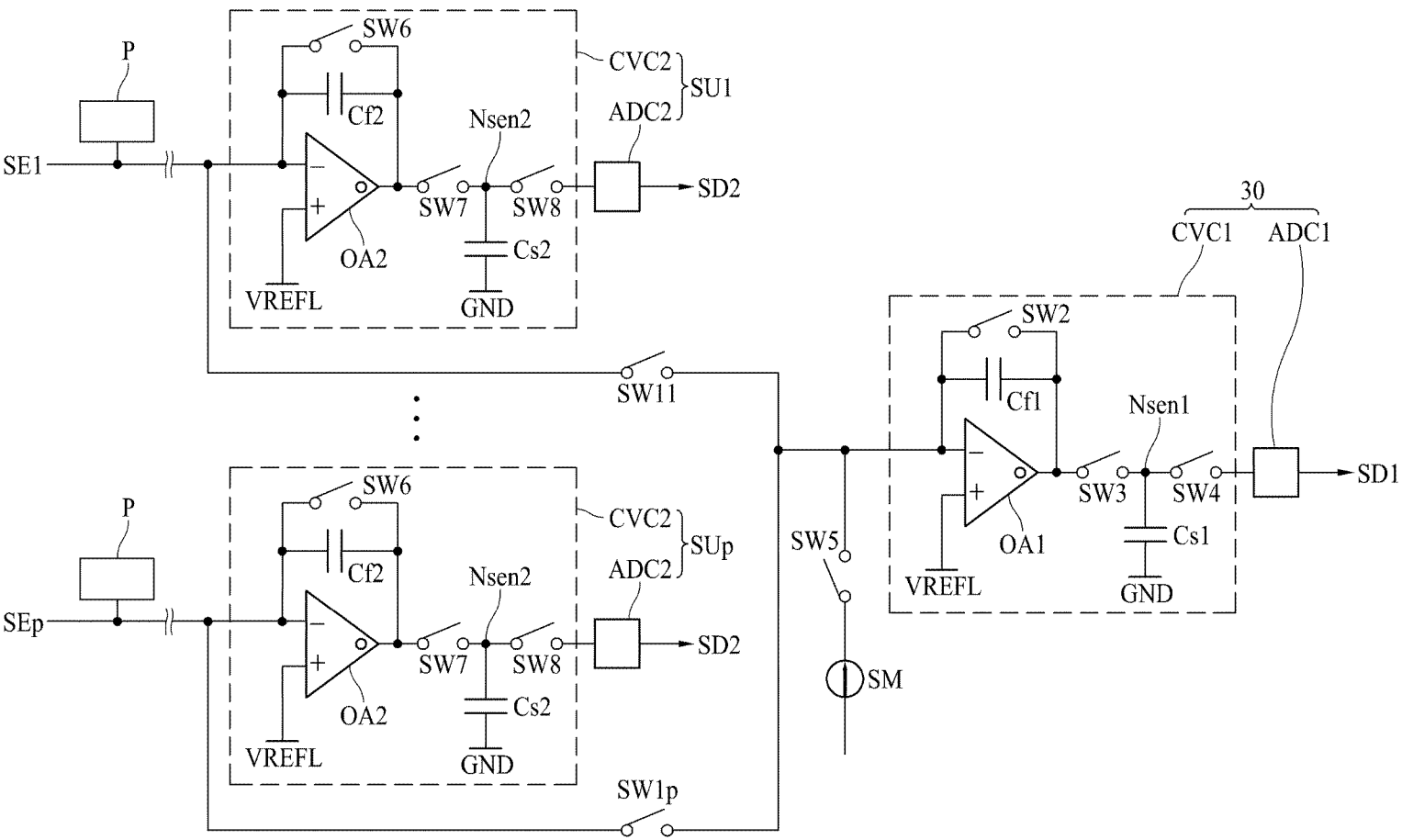
FIG. 7 is another detailed circuit diagram illustrating a switching unit and a sensing data output unit.

The sensing data output unit 30 is connected to the sensing lines SE1 to SEp by means of the switching unit 120 as shown in FIG. 3 and senses currents flowing into the sensing lines SE1 to SEp. That is, the sensing data output unit 30 converts the current flowing to each of the sensing lines SE1 to SEp to a voltage and converts the converted voltage to first sensing data SD1 corresponding to digital data. To this end, as shown in FIGS. 5 and 7, the sensing data output unit 30 may include a first current-to-voltage converter CVC1 converting the current flowing to each of the sensing lines SE1 to SEp to a voltage and a first analog-to-digital converter ADC1 converting an output voltage of the first current-to-voltage converter CVC1 to the first sensing data SD1 corresponding to digital data. The sensing data output unit 30 outputs the first sensing data SD1 to the digital data compensation unit 70. A detailed description of the sensing data output unit 30 will be described later with reference to FIGS. 5 and 7.

Meanwhile, the switching unit 120 may further include sensing units SU1 to SUp as shown in FIG. 7. Each of the sensing units SU1 to SUp is connected to each of the sensing lines SE1 to SEp and senses the current flowing to each of the sensing lines SE1 to SEp. Each of the sensing units SU1 to SUp converts the current flowing to each of the sensing lines SE1 to SEp to the voltage, and converts the converted voltage to second sensing data SD2 corresponding to digital data. To this end, each of the sensing units SU1 to SUp may include a second current-to-voltage converter CVC2 converting the current flowing to each of the sensing lines SE1 to SEp to a voltage and a second analog-to-digital converter ADC2 converting an output voltage of the second current-to-voltage converter CVC2 to the second sensing data SD1 corresponding to digital data. Each of the sensing units SU1 to SUp outputs the second sensing data SD1 to the digital data compensation unit 70. A detailed description of the sensing units SU1 to SUp will be described later with reference to FIG. 7.

The scan driver 40 is connected to the scan lines S1 to Sn and supplies the scan signals. The scan driver 40 supplies the scan signals to the scan lines S1 to Sn in accordance with the scan timing control signal SCS input from the timing controller 60. The scan driver 40 may sequentially supply the scan signals to the scan lines S1 to Sn. In this case, the scan driver 40 may include a shift register. The scan timing control signal SCS of the display mode may be different from that of the sensing mode, whereby a scan signal waveform of the scan driver 40 in the display mode may be different from that of the scan driver 40 in the sensing mode.

The sensing driver 50 is connected to the sensing signal lines SS1 to SSn and supplies the sensing signals. The sensing driver 50 supplies the sensing signals to the sensing signal lines SS1 to SSn in accordance with a sensing timing control signal SENCS input from the timing controller 60. The sensing driver 50 may sequentially supply the sensing signals to the sensing signal lines SS1 to SSn. In this case, the sensing driver 50 may include a shift register. The sensing timing control signal SENCS of the display mode may be different from that of the sensing mode, whereby a scan signal waveform of the sensing driver 50 in the display mode may be different from that of the sensing driver 50 in the sensing mode.

Each of the scan driver 40 and the sensing driver 50 may include a plurality of transistors and may directly be formed in the non-display area NAA of the display panel 10 in a Gate driver In Panel (GIP) manner. Alternatively, each of the scan driver 40 and the sensing driver 50 may be formed in the form of a driving chip and then packaged in a flexible film (not shown) connected to the display panel 10.

The timing controller 60 receives compensated data CDATA or predetermined data PDATA and a timing signal from the digital data compensation unit 70. The timing signal may include a vertical synchronization signal, a horizontal synchronization signal, a data enable signal, and a dot clock.

The timing controller 60 generates timing control signals for controlling operation timing of the data driver 20, the scan driver 40 and the sensing driver 50. The timing control signals include a data timing control signal DCS for controlling operation timing of the data driver 20, a scan timing control signal SCS for controlling operation timing of the scan driver 40, and a sensing timing control signal SENCS for controlling operation timing of the sensing driver 50.

The timing controller 60 operates the data driver 20, the scan driver 40 and the sensing driver 50 in any one of the display mode and the sensing mode in accordance with a mode signal MODE. The display mode is to allow the pixels P of the display panel 10 to display images, and the sensing mode is to sense the current of the driving transistor of each of the pixels P of the display panel 10. If the scan signal waveform and the sensing signal waveform supplied from each of the display mode and the sensing mode to each of the pixels P are varied, the timing control signal DCS, the scan timing control signal SCS, and the sensing timing control signal SENCS may also be varied in each of the display mode and the sensing mode. Therefore, the timing controller 60 generates the data timing control signal DCS, the scan timing control signal SCS and the sensing timing control signal SENCS depending on the display mode or the sensing mode.

The timing controller 60 outputs the compensated data CDATA or the predetermined data PDATA and the data timing control signal DCS to the data driver 20. The timing controller 60 outputs the scan timing control signal SCS to the scan driver 40. The timing controller 60 outputs the sensing timing control signal SENCS to the sensing driver 50.

Also, the timing controller 60 may output first switching control signals SCS1 for controlling the first switches SW11 to SW1*p* of the switching unit 120 of the data driver 20 to the switching unit 120. The timing controller 60 supplies initialization signals RS for controlling the initialization switches SWR1 to SWRp of the initialization voltage supply unit 130 of the data driver 20 to the initialization voltage supply unit 130. If the sensing data output unit 30 includes second to fifth switches SW2, SW3, SW4 and SW5 as shown in FIGS. 5 and 7, the timing controller 60 may output second to fifth switching control signals SCS2, SCS3, SCS4 and SCS5 for controlling the second to fifth switches SW2, SW3, SW4 and SW5 to the sensing data output unit 30. Moreover, if the switching unit 120 of the data driver 20 includes sixth to eighth switches SW6, SW7 and SW8 as shown in FIG. 7, the timing controller 60 may output sixth to eighth switches SW6, SW7 and SW8 t the switching unit 120.

Also, the timing controller 60 generates a mode signal MODE depending on whether to drive the data driver 20, the scan driver 40, the sensing driver 50 and the digital data compensation unit 70 in the display mode or the sensing mode. The timing controller 60 internally operates the data driver 20, the scan driver 40, and the sensing driver 50 in the display mode or the sensing mode in accordance with the mode signal MODE. The timing controller 60 outputs the mode signal MODE to the digital data compensation unit 70.

The digital data compensation unit 70 receives either first sensing data SD1 or both first and second sensing data SD1 and SD2 from the data driver 20. If the switching unit 120 includes first switches SW11 to SW1*p* only as shown in FIG. 5, the digital data compensation unit 70 does not receive the second sensing data SD2, and if the switching unit 120 includes sensing units SU1 to SU2 as shown in FIG. 7, the digital data compensation unit 70 receives the second sensing data SD2 from the sensing units SU1 to Sup. The digital data compensation unit 70 may store either the first sensing data SD1 or both the first and second sensing data SD1 and SD2 in a memory (not shown). Also, the digital data compensation unit 70 receives digital video data DATA from the outside, and receives the mode signal MODE from the timing controller 60. The digital data compensation unit 70 outputs the digital data to the timing controller 60 in accordance with the mode signal MODE.

The digital data compensation unit 70 may externally compensate for the threshold voltage and mobility of the driving transistor DT by compensating the digital video data DATA to the compensated data CDATA on the basis of either the first sensing data SD1 or the first and second sensing data SD1 and SD2 in the display mode. In more detail, the first sensing data SD1 or the first and second sensing data SD1 and SD2 are data obtained by sensing of the current flowing through the driving transistor DT when a predetermined data voltage is supplied to a gate electrode of the driving transistor DT of the pixel P. The compensated data CDATA means data obtained by compensating for the threshold voltage and mobility of the driving transistor DT of each of the pixels P. The digital data compensation unit 70 may calculate data for compensating for the threshold voltage and mobility of the driving transistor DT from the first sensing data SD1 or the first and second sensing data SD1 and SD2 by using a predetermined algorithm, and may calculate compensated data CDATA by applying the calculated data to the digital video data DATA. The digital data compensation unit 70 supplies the compensated data CDATA to the timing controller 60 in the display mode.

The digital data compensation unit 70 supplies the predetermined data PDATA stored in the memory (not shown) to the timing controller 60 in the sensing mode. The predetermined data PDATA is to allow each of the pixels P to sense the current of the driving transistor DT.

The timing controller 60 and the digital data compensation unit 70 may be packaged in the control circuit board 90 as shown in FIG. 2. The digital data compensation unit 70 may be built in the timing controller 60. The control circuit board 90 may be connected to the source circuit board 80 by the flexible cable 91. The control circuit board 90 may be a printed circuit board.

FIG. 4 is a detailed circuit diagram illustrating the pixels of FIG. 1. In FIG. 4, for convenience of description, a pixel P connected to a jth (j is a positive integer that satisfies $1 \leq j \leq m$) data line Dj, a jth sensing line SEj, a kth (k is a positive integer that satisfies $1 \leq k \leq n$) sensing line Sk and a kth sensing signal line SSk is only shown.

With reference to FIG. 4, the pixel P of the display panel 10 includes an organic light emitting diode OLED and a pixel driver PD supplying a current to the organic light emitting diode OLED and the jth sensing line SEj. The pixel driver PD may include a driving transistor DT, first and second transistors ST1 and ST2, and a capacitor C as shown in FIG. 4.

The organic light emitting diode OLED emits light in accordance with the current supplied through the driving transistor DT. An anode electrode of the organic light emitting diode OLED may be connected to a source electrode of the driving transistor DT, and a cathode electrode of the organic light emitting diode OLED may be connected to a low potential voltage line VSSL to which a low potential voltage lower than a high potential voltage is supplied.

The organic light emitting diode OLED may include the anode electrode, a hole transporting layer, an organic light emitting layer, an electron transporting layer, and the cathode electrode. If a voltage is applied to the anode electrode and the cathode electrode of the organic light emitting diode OLED, holes and electrons are moved to the organic light emitting layer through the hole transporting layer and the electron transporting layer, respectively, and are combined with each other in the organic light emitting layer, so as to emit light. The anode electrode of the organic light emitting diode OLED may be connected to the source electrode of the driving transistor DT, and the cathode electrode of the organic light emitting diode OLED may be connected to a second power voltage line ELVSSL to which a second power voltage is supplied.

The driving transistor DT is provided between a first power voltage line VDDL and the organic light emitting diode OLED. The driving transistor DT controls a current flowing from the first power voltage line VDDL to the organic light emitting diode OLED, in accordance with a voltage difference between the gate electrode and the source electrode. The gate electrode of the driving transistor DT may be connected to the first electrode of the first transistor ST1, its source electrode may be connected to the anode electrode of the organic light emitting diode OLED, and its drain electrode may be connected to the first power voltage line VDDL to which the first power voltage is supplied.

The first transistor ST1 is turned on by the kth scan signal of the kth scan line Sk to supply a voltage of the jth data line Dj to the gate electrode of the driving transistor DT. The gate electrode of the first transistor T1 may be connected to the kth scan line Sk, the first electrode may be connected to the gate electrode of the driving transistor DT, and the second electrode may be connected to the jth data line Dj. The first transistor ST1 may be referred to as a scan transistor.

The second transistor ST2 is turned on by the kth sensing signal of the kth sensing signal line SSk to connect the first sensing line SEj to the source electrode of the driving transistor DT. The gate electrode of the second transistor T2 may be connected to the kth initialization line SENk, the first electrode may be connected to the jth sensing line SEj, and the second electrode may be connected to the source electrode of the driving transistor DT. The second transistor ST2 may be referred to as a sensing transistor.

A first capacitor C1 is provided between the gate and source electrodes of the first driving transistor DT1. The first capacitor C1 stores a differential voltage between a gate voltage and a source voltage of the first driving transistor DT1.

In FIG. 2, the driving transistor DT and the first and second transistors ST1 and ST2 are formed as, but not limited to, N type MOSFET (Metal Oxide Semiconductor Field Effect Transistors). The driving transistor DT and the first and second transistors ST1 and ST2 may be formed as P type MOSFETs. Also, it should be noted that the first electrode may be, but not limited to, the source electrode and the second electrode may be, but not limited to, the drain electrode. That is, the first electrode may be the drain electrode, and the second electrode may be the source electrode.

Meanwhile, in the display mode, when the scan signal is supplied to the kth scan line Sk, the luminescence data voltage of the jth data line Dj is supplied to the gate electrode of the driving transistor DT, and when the sensing signal is supplied to the kth sensing signal line SSk, the initialization voltage of the jth sensing line SEj is supplied to the source electrode of the driving transistor DT. For this reason, in the display mode, the current of the driving transistor DT, which flows in accordance with the voltage difference between the voltage of the gate electrode of the driving transistor DT and the voltage of the source electrode of the driving transistor DT, is supplied to the organic light emitting diode OLED, and the organic light emitting diode OLED emits light in accordance with the current of the driving transistor DT. At this time, since the luminescence data voltage is the voltage obtained by compensating the threshold voltage and mobility of the driving transistor DT, the current of the driving transistor DT does not depend on the threshold voltage and mobility of the driving transistor DT.

Also, in the sensing mode, when the scan signal is supplied to the kth scan line Sk, the sensing data voltage of the jth data line Dj is supplied to the gate electrode of the driving transistor DT, and when the sensing signal is supplied to the kth sensing signal line SSk, the initialization voltage of the jth sensing line SEj is supplied to the source electrode of the driving transistor DT. Also, in the sensing mode, the second transistor ST2 is turned on by the sensing signal of the kth sensing signal line SSk to flow the current of the driving transistor DT, which flows in accordance with the voltage difference between the voltage of the gate electrode of the driving transistor DT and the voltage of the source electrode of the driving transistor DT, to the jth sensing line SEj. As a result, the sensing data output unit 30 may output the first sensing data SD1 by sensing the current flowing to the jth sensing line SEj in accordance with switching of the switching unit 120, and the digital data compensation unit 70 may externally compensate for the threshold voltage and mobility of the driving transistor DT by using the first sensing data SD1.

FIG. 5 is a detailed circuit diagram illustrating a switching unit and a sensing data output unit of FIG. 3. With reference to FIG. 5, the switching unit 120 includes first switches SW11 to SW1*p* connected to the sensing lines SE1 to SEp.

Each of the first switches SW11 to SW1*p* is switched by each of the first switch signals SCS11 to SCS1*p*. In more detail, each of the first switches SW11 to SW1*p* may be turned on if each of the first switch signals SCS11 to SCS1*p* corresponding to first logic level voltages is supplied thereto, and may be turned off if each of the first switch signals SCS11 to SCS1*p* corresponding to second logic level voltages is supplied thereto.

The first switches SW11 to SW1*p* are controlled so as not to be turned on simultaneously. For this reason, the sensing data output unit 30 may be connected to each of the sensing lines SE1 to SEp. Therefore, the sensing data output unit 30 may sense the current flowing to each of the sensing lines SE1 to SEp and output the sensed current as the first sensing data SD1.

Each of the first switches SW11 to SW1*p* is connected to each of the sensing lines SE1 to SEp one to one. In this case, each of the sensing lines SE1 to SEp may be connected to the sensing data output unit 30 in a predetermined order by switching of the first switches SW11 to SW1*p*. Therefore, the sensing data output unit 30 may output the first sensing data SD by sensing the current of each of the sensing lines SE1 to SEp connected thereto in a predetermined order.

The sensing data output unit 30 includes a first current-to-voltage converter CVC1 and a first analog-to-digital converter ADC1. The first current-to-voltage converter CVC1 converts a current flowing to the qth (q is a positive integer that satisfies $1 \leq q \leq p$) sensing line SEq to a voltage. The first current-to-voltage converter CVC1 may include a first operation amplifier OA1, a first feedback capacitor Cf1, and second to fifth switches SW2, SW3, SW4 and SW5.

The first operation amplifier OA1 includes an inversion terminal (−), a non-inversion terminal (+), and an output terminal (○). The inversion terminal (−) of the first operation amplifier OA1 is connected to the qth sensing line SEq through the first switch SW11, the non-inversion terminal (+) is connected to the initialization voltage line VREFL to which the initialization voltage corresponding to a direct current voltage is supplied, and the output terminal (○) is connected to the second switch SW2.

The second switch SW2 is switched in accordance with the second switch signal SCS2. The second switch SW2 is turned on by the second switch signal SCS2 and connects the inversion terminal (−) and the output terminal (○) of the first operation amplifier OA1 with each other.

The third switch SW3 is switched in accordance with the third switch signal SCS3. The third switch SW3 is turned on by the third switch signal SCS3 and connects the output terminal (○) of the first operation amplifier OA1 with a first sensing node Nsen1.

The fourth switch SW4 is switched in accordance with the fourth switch signal SCS4. The fourth switch SW4 is turned on by the fourth switch signal SCS4 and connects the first sensing node Nsen1 with the first analog-to-digital converter ADC1.

The fifth switch SW5 is switched in accordance with the fifth switch signal SCS5. The fifth switch SW5 is turned on by the fifth switch signal SCS5 and connects the first current-to-voltage converting circuit CVC1 with a current supply source SM. The current supply source SM supplies a predetermined reference current to the first current-to-voltage converting circuit CVC1.

The first feedback capacitor Cf1 is connected between the inversion terminal (−) and the output terminal (○) of the first operation amplifier OA1. If the second switch SW2 is turned on, the inversion terminal (−) and the output terminal (○) of the first operation amplifier OA1 are shorted, whereby the first feedback capacitor Cf1 may be initialized to a zero voltage 0V. Also, if the second switch SW2 is turned off and the third switch SW3 is turned on, the first feedback capacitor Cf1 varies the voltage output to the output terminal (○) of the first operation amplifier OA1 by charging the current of the qth sensing line SEq.

A first storage capacitor Cs1 is connected between the first sensing node Nsen1 and a ground voltage source GND. If the second and fourth switches SW2 and SW4 are turned off and the third switch SW3 is turned on, the first storage capacitor Cs1 stores a voltage output from the first operation amplifier OA1, that is, a voltage of the first sensing node Nsen1.

If the fourth switch SW4 is turned on, the first analog-to-digital converter ADC1 converts the voltage of the first sensing node Nsen1 to the first sensing data SD1 corresponding to digital data. The first analog-to-digital converter ADC1 outputs the first sensing data SD1 to the digital data compensation unit 70.

Meanwhile, each of the sensing lines SE1 to SEp is connected to the sensing unit to output sensing data in the related art, whereas the sensing lines SE1 to SEp may be connected to one sensing data output unit 30 in a predetermined order by using the switching unit 120 in the present invention, whereby the currents of the sensing lines SE1 to SEp may be sensed, using one sensing data output unit 30, to be output as the first sensing data SD1. As a result, in the embodiment of the present invention, the problem that the difference between the first sensing data SD1 output from the sensing data output units 30 occurs due to the difference in sensing capability between the sensing data output units 30 may be solved, whereby sensing accuracy may be enhanced.

Also, in the embodiment of the present invention, each sensing data output unit 30 is not provided inside each of the source drive ICs 21 but provided in the source circuit board 80. As a result, in the embodiment of the present invention, since the sensing data output unit 30 is not provided, circuit complexity of the source drive IC 21 may be lowered, whereby the manufacturing cost of the source drive IC 21 may be reduced. Also, in the embodiment of the present invention, since the sensing data output unit 30 is provided in the source circuit board 80, there is no restriction in a circuit size of the sensing data output unit 30, whereby the first operation amplifier OA1 of the sensing data output unit 30 may be used as a high performance operation amplifier. Therefore, in the embodiment of the present invention, sensing accuracy may be enhanced.

FIG. 6 is a waveform illustrating first switch signals supplied to first switches of FIG. 5 and second to fifth switch signals supplied to second to fifth switches of FIG. 5. The first switch signals SCS11 to SCS1*p* and second to fifth switch signals SCS2 to SCS5, which are supplied in the sensing mode, are illustrated in FIG. 6. In the display mode, the first switch signals SCS11 to SCS1*p* and the second to fifth switch signals SCS2 to SCS5 may be supplied as second logic level voltages V2.

With reference to FIG. 6, pulses of the first switch signals SCS11 to SCS1*p* having the first logic level voltages V1 in the sensing mode may be supplied in a predetermined order. The predetermined order may be a sequential order as shown in FIG. 6. For this reason, the first switches SW11 to SW1*p* may be turned on in the predetermined order, and each of the sensing lines SE1 to SEp may be connected to the sensing data output unit 30 in the predetermined order.

Also, the pulses of the first switch signals SCS11 to SCS1*p* are not overlapped with one another as shown in FIG. 6. For this reason, the first switches SW11 to SW1*p* may be turned on in a sequential order from the first switch SW11 connected to the first sensing line SSE1 to the first switch SW1*p* connected to the pth sensing line SEp.

In the sensing mode, each of the pulses of the first switch signals SW11 to SW1*p* may be categorized into first to third time periods t1 to t3 as shown in FIG. 6. In the sensing mode, the second switch signal SCS2 has a first logic level voltage V1 for the first time period t1, and has a second logic level voltage V2 for the second and third time periods t2 and t3. In the sensing mode, the third switch signal SCS3 has a first logic level voltage V1 for the first and second time periods t1 and t2 and has a second logic level voltage V2 for the third time period t3. In the sensing mode, the fourth switch signal SCS4 has a first logic level voltage V1 for the first and second time periods t1 and t2 and has a second logic level voltage V2 for the third time period t3.

A pulse of the fifth switch signal SCS5 having a first logic level voltage V1 may be generated subsequently to the pulses of the first switch signals SW11 to SW1*p*. However, it should be noted that generation of the pulse of the fifth switch signal SCS5 is not limited to the above example. That is, the pulse of the fifth switch signal SCS5 may be generated prior to the pulses of the first switch signals SW11 to SW1*p*. A pulse width of the fifth switch signal SCS5 may be substantially the same as that of each of the pulses of the first switch signals SW11 to SW1*p*.

Hereinafter, an operation of the sensing data output unit 30 for the first to third time periods t1 to t3 of the pulse of the first switch signal SCS1 supplied to the first switch SW11 connected to the first sensing line SE1 will be described in more detail with reference to FIGS. 5 and 6. In this case, the first switch SW11 connected to the first sensing line SE1 is turned on, and the other switches SW12 to SW1*p* connected to the other sensing lines SE1 to Sep are turned off. Therefore, the sensing data output unit 30 is connected to the first sensing line SE11. Also, since the fifth switch signal SCS5 is supplied as the second logic level voltage V2 for the first to third time periods t1 to t3, the fifth switch SW5 is turned off.

First, for the first time period t1, the second switch SW2 is turned on by the second switch signal SCS2 of the first logic level voltage V1, the third switch SW3 is turned on by the third switch signal SCS3 of the first logic level voltage V1, and the fourth switch SW4 is turned off by the fourth switch signal SCS4 of the second logic level voltage V2. The inversion terminal (−) and the output terminal (○) of the first operation amplifier OA1 are shorted as the second and third switches SW2 and SW3 are turned on for the first time period t1. Therefore, the first feedback capacitor Cf1 is initialized to a zero voltage 0V.

Second, for the second time period t2, the second switch SW2 is turned off by the second switch signal SCS2 of the second logic level voltage V2, the third switch SW3 is turned on by the third switch signal SCS3 of the first logic level voltage V1, and the fourth switch SW4 is turned off by the fourth switch signal SCS4 of the second logic level voltage V2. The inversion terminal (−) and the output terminal (○) of the first operation amplifier OA1 are not connected to each other any longer as the second switch SW2 is turned off, whereby the first operation amplifier OA1 is operated as an integrator. Also, the output terminal (○) of the first operation amplifier OA1 is connected to the first sensing node Nsen1 as the third switch SW3 is turned on. Therefore, the first operation amplifier OA1 converts the current of the driving transistor DT, which flows to the first sensing line SE1, to the voltage, wherein the converted voltage is stored in the first storage capacitor Cs1.

Third, for the third time period t3, the second switch SW2 is turned off by the second switch signal SCS2 of the second logic level voltage V2, the third switch SW3 is turned off by the third switch signal SCS3 of the second logic level voltage V2, and the fourth switch SW4 is turned on by the fourth switch signal SCS4 of the first logic level voltage V1. The output terminal (○) of the first operation amplifier OA1 and the first sensing node Nsen1 are disconnected from each other as the third switch SW3 is turned off. The first sensing node Nsen1 is connected to the first analog-to-digital converter ADC1 as the fourth switch SW4 is turned on. Therefore, the first analog-to-digital converter ADC1 converts the voltage of the first sensing node Nsen1, which is stored in the first storage capacitor Cs1, to the first sensing data SD1 corresponding to digital data. The first analog-to-digital converter ADC1 outputs the first sensing data SD1 to the digital data compensation unit 70.

Meanwhile, since the operation of the sensing data output unit 30 for the first to third time periods t1 to t3 of each of the other pulses of the first switch signals SCS12 to SCS1*p* and the pulse of the fifth switch signal SCS5 is substantially the same as that described as above, its detailed description will be omitted.

The sensing data output unit 80 may output reference data by sensing a reference current supplied from the power supply source SM. That is, if the fifth switch SW5 is turned on by the fifth switch signal SCS5, the reference current from the current supply source SM is converted to the voltage by the first analog-to-digital converter ADC1, and the converted voltage may be converted to reference data corresponding to digital data by means of the first analog-to-digital converter ADC1. As a result, in the embodiment of the present invention, if the plurality of sensing data output units 30 are provided as shown in FIG. 2, the reference data output from the sensing data output units 30 are compared with one another, whereby the difference in sensing capability between the respective sensing data output units 30 may be compensated. As a result, in the embodiment of the present invention, the problem that the difference between the first sensing data SD1 output from the sensing data output units 30 occurs due to the difference in sensing capability between the sensing data output units 30 may be solved, whereby sensing accuracy may be enhanced.

FIG. 7 is another detailed circuit diagram illustrating a switching unit and a sensing data output unit. With reference to FIG. 7, the switching unit 120 first switches SW11 to SW1*p* connected to the sensing lines SE1 to SEp and sensing units SU1 to SUp connected to the sensing lines SE1 to SEp. For convenience of description, the sensing units SU1 and SUp and switches SW11 and SW1*p*, which are connected to the first and pth sensing lines SE1 and SEp are only shown in FIG. 7. Since the first switches SW11 to SW1*p* and the sensing data unit 30, which are shown in FIG. 7, are substantially the same as those shown in FIG. 5, their detailed description will be omitted.

Each of the sensing units SU1 to SUp is connected to each of the sensing lines SE1 to SEp one to one. Each of the sensing units SU1 to SUp includes a second current-to-voltage converter CVC2 and a second analog-to-digital converter ADC2. The second current-to-voltage converter CVC2 converts a current flowing to the qth sensing line SEq to a voltage. The second current-to-voltage converter CVC2 may include a second operation amplifier OA2, a second feedback capacitor Cf2, and sixth to eighth switches SW6, SW7 and SW8.

The second operation amplifier OA2 includes an inversion terminal (−), a non-inversion terminal (+), and an output terminal (○). The inversion terminal (−) of the second operation amplifier OA2 is connected to the qth sensing line SEq, the non-inversion terminal (+) is connected to the initialization voltage line VREFL to which the initialization voltage corresponding to a direct current voltage is supplied, and the output terminal (○) is connected to the seventh switch SW7.

The sixth switch SW6 is switched in accordance with the sixth switch signal SCS6. The sixth switch SW6 is turned on by the sixth switch signal SCS6 and connects the inversion terminal (−) and the output terminal (○) of the first operation amplifier OA1 with each other.

The seventh switch SW7 is switched in accordance with the seventh switch signal SCS7. The seventh switch SW7 is turned on by the seventh switch signal SCS7 and connects the output terminal (○) of the second operation amplifier OA2 with a second sensing node Nsen2.

The eighth switch SW8 is switched in accordance with the eighth switch signal SCS8. The eighth switch SW8 is turned on by the eighth switch signal SCS8 and connects the second sensing node Nsen2 with the second analog-to-digital converter ADC2.

The second feedback capacitor Cf2 is connected between the inversion terminal (−) and the output terminal (○) of the second operation amplifier OA1. If the sixth switch SW6 is turned on, the inversion terminal (−) and the output terminal (○) of the second operation amplifier OA2 are shorted, whereby the second feedback capacitor Cf2 may be initialized to a zero voltage 0V. Also, if the sixth switch SW6 is turned off and the seventh switch SW7 is turned on, the second feedback capacitor Cf2 varies the voltage output to the output terminal (○) of the second operation amplifier OA2 by charging the current of the qth sensing line SEq.

A second storage capacitor Cs2 is connected between the second sensing node Nsen2 and a ground voltage source GND. If the sixth and eighth switches SW6 and SW8 are turned off and the seventh switch SW7 is turned on, the second storage capacitor Cs2 stores a voltage output from the second operation amplifier OA2, that is, a voltage of the second sensing node Nsen2.

If the eighth switch SW8 is turned on, the second analog-to-digital converter ADC2 converts the voltage of the second sensing node Nsen2 to the second sensing data SD2 corresponding to digital data. The second analog-to-digital converter ADC2 outputs the second sensing data SD2 to the digital data compensation unit 70.

Meanwhile, a circuit size of each of the sensing units SU1 to SUp is preferably smaller than that of the sensing data output unit 30. Since the sensing units SU1 to SUp are included in the source drive IC 21, they have a restriction in the circuit size as compared with the sensing data output unit 30. On the other hand, since the sensing data output unit 30 is provided in the source circuit board 80, the sensing data output unit 30 has a restriction in the circuit size relatively smaller than that of the sensing units SU1 to SUp.

In the embodiment of the present invention, the sensing lines SE1 to SEp may be connected to one sensing data output unit 30 in a predetermined order by using the switching unit 120, whereby the currents of the sensing lines SE1 to SEp may be sensed, using one sensing data output unit 30, to be output as the first sensing data SD1. Also, the currents of the sensing lines SE1 to SEp may be sensed, using the sensing units SU1 to SUp included in the switching unit 120, to output the second sensing data SD2. As a result, in the embodiment of the present invention, the first sensing data SD1 may be compared with the second sensing data SD2, whereby the difference in sensing capability between the sensing units SU1 to SUp may be compensated. In this case, the sensing data output unit 30 may be used to compensate for the difference in sensing capability of the sensing units SU1 to SUp, and may sense the currents of the sensing lines SE1 to SEp by using the sensing units SU1 to SUp. As a result, the problem that the difference between the second sensing data SD2 output from the sensing units SU1 to SUp occurs due to the difference in sensing capability between the sensing units SU1 to SUp may be solved, whereby sensing accuracy may be enhanced.

Figure 8:
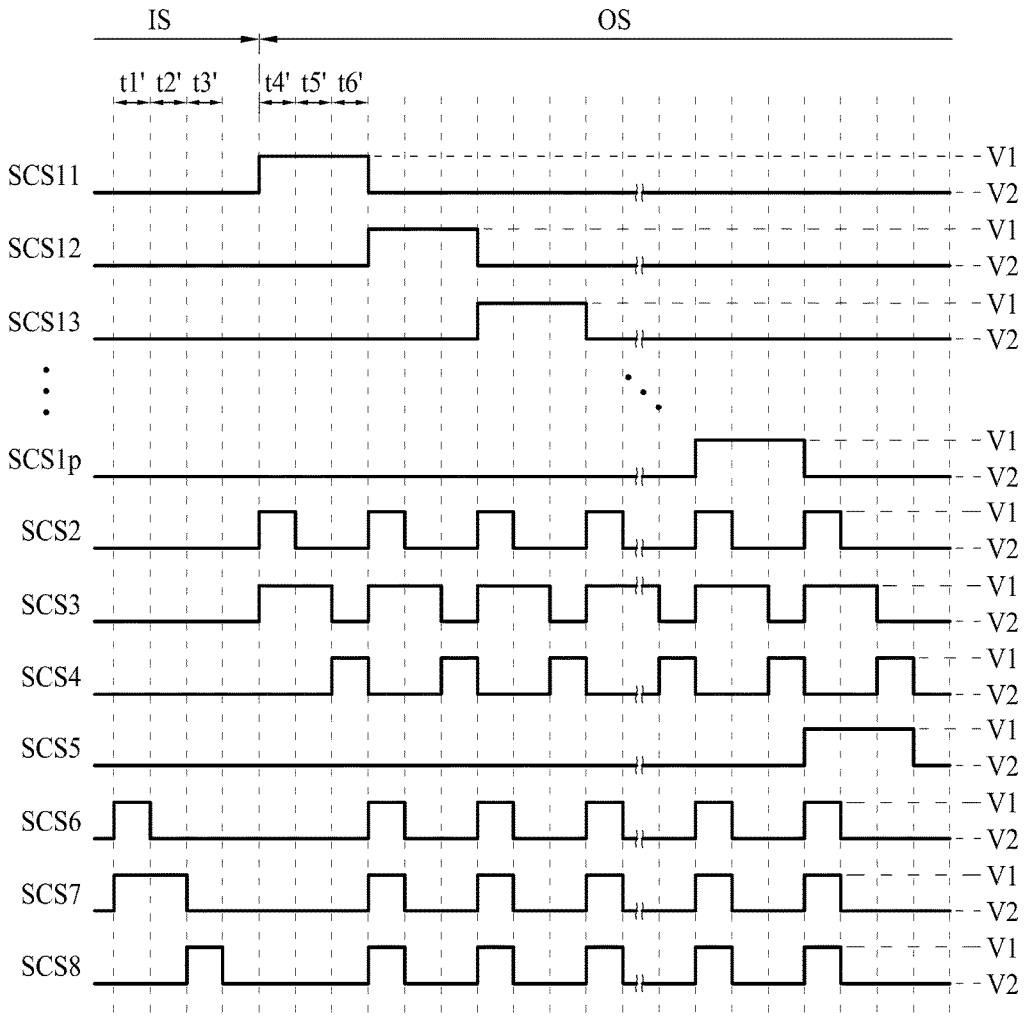
FIG. 8 is a waveform illustrating first switch signals supplied to first switches of FIG. 7 and second to eighth switch signals supplied to second to eighth switches of FIG. 7.

FIG. 8 is a waveform illustrating first switch signals supplied to first switches of FIG. 7 and second to eighth switch signals supplied to second to eighth switches of FIG. 7. The first switch signals SCS11 to SCS1*p* and second to eighth switch signals SCS2 to SCS8, which are supplied in the sensing mode, are illustrated in FIG. 8. In the display mode, the first switch signals SCS11 to SCS1*p* and the second to eighth switch signals SCS2 to SCS8 may be supplied as second logic level voltages V2.

With reference to FIG. 8, the sensing mode may be categorized into an internal sensing period IS and an external sensing period OS. The internal sensing period IS indicates a period for outputting the second sensing data SD2 by sensing the currents of the sensing lines SE1 to SEp using the sensing units SU1 to Sup of the switching unit 120 included in the source drive IC 21. The external sensing period OS indicates a period for outputting the first sensing data SD1 by sensing the currents of the sensing lines SE1 to SEp using the sensing data output units 30 provided in the source drive IC 21.

The internal sensing period IS may be categorized into first to third time periods t1' to t3'. For the first to third time periods t1' to t3' of the internal sensing period IS, the first switch signals SCS11 to SCS1*p* of the second logic level voltages V2, the second switch signal SCS2 of the second logic level voltage V2, the third switch signal SCS3 of the second logic level voltages V2, the fourth switch signal SCS4 of the second logic level voltage V2, and the fifth switch signal SCS5 of the second logic level voltage V2 are supplied. The sixth switch signal SCS6 has the first logic level voltage V1 for the first time period t1', and has the second logic level voltage V2 for the second and third time periods t2' and t3'. The seventh switch signal SCS7 has the first logic level voltage V1 for the first and second time periods t1' and t2' and has the second logic level voltage V2 for the third time period t3'. The eighth switch signal SCS8 has the first logic level voltage V1 for the first and second time periods t1' and t2', and has the second logic level voltage V2 for the third time period t3'.

First switch signals S11 to S1*p* and second to fifth switch signals SCS2 to SCS5 for the external sensing period OS are substantially the same as those described with reference to FIG. 6. Therefore, a detailed description of the first switch signals S11 to S1*p* and the second to fifth switch signals SCS2 to SCS5 for the external sensing period OS will be omitted. For the external sensing period OS, the sixth switch signal SCS6 of the second logic level voltage V2, the seventh switch signal SCS7 of the second logic level voltage V2 and the eighth switch signal SCS8 of the second logic level voltages V2 are supplied.

Hereinafter, the operation of the sensing unit SU1 connected to the first sensing line SE1 for the internal sensing period IS will be described in detail with reference to FIGS. 7 and 8.

Since the first switch signals SCS11 to SCS1*p* of the second logic level voltages V2 are supplied for the internal sensing period IS, the first switches SW11 to SW1*p* are turned off. For this reason, the sensing data output unit 30 is not connected to the sensing lines SE1 to SEp for the internal sensing period IS.

First of all, for the first time period t1', the sixth switch SW6 is turned on by the sixth switch signal SCS6 of the first logic level voltage V1, the seventh switch SW7 is turned on by the seventh switch signal SCS7 of the first logic level voltages V1, and the eighth switch SW8 is turned off by the eighth switch signal SCS8 of the second logic level voltage V2. The inversion terminal (−) and the output terminal (○) of the second operation amplifier OA2 are shorted as the sixth and seventh switches SW6 and SW7 are turned on for the first time period t1'. Therefore, the second feedback capacitor Cf2 is initialized to a zero voltage 0V.

Second, for the second time period t2', the sixth switch SW6 is turned off by the sixth switch signal SCS6 of the second logic level voltage V2, the seventh switch SW7 is turned on by the seventh switch signal SCS7 of the first logic level voltages V1, and the eighth switch SW8 is turned off by the eighth switch signal SCS8 of the second logic level voltage V2. The inversion terminal (−) and the output terminal (○) of the second operation amplifier OA2 are not connected to each other any longer as the sixth switch SW6 is turned off, the second operation amplifier OA2 is operated as an integrator. Also, the output terminal (○) of the second operation amplifier OA2 is connected to the second sensing node Nsen2 as the seventh switch SW7 is turned on. Therefore, the second operation amplifier OA2 converts the current of the driving transistor DT, which flows to the first sensing line SE1, to the voltage, wherein the converted voltage is stored in the second storage capacitor Cs2.

Third, for the third time period t3', the sixth switch SW6 is turned off by the sixth switch signal SCS6 of the second logic level voltage V2, the seventh switch SW7 is turned off by the seventh switch signal SCS7 of the second logic level voltage V2, and the eighth switch SW8 is turned on by the eighth switch signal SCS8 of the first logic level voltage V1. The output terminal (○) of the second operation amplifier OA2 and the second sensing node Nsen2 are disconnected from each other as the sixth switch SW6 is turned off. The second sensing node Nsen2 is connected to the second analog-to-digital converter ADC2 as the seventh switch SW7 is turned on. Therefore, the second analog-to-digital converter ADC2 converts the voltage of the second sensing node Nsen2, which is stored in the second storage capacitor Cs2, to the second sensing data SD2 corresponding to digital data. The second analog-to-digital converter ADC2 outputs the second sensing data SD2 to the digital data compensation unit 70.

Since the operation of the sensing data output unit 30 for the fourth to sixth time periods t4' to t6' of a pulse of the first switch signal SCS11 supplied to the first switch SW11 connected to the first sensing line SE1 connected to the first sensing line SE1 for the external sensing period OS is substantially the same as that of the sensing data output unit 30 for the first to third time periods t1 to t3 described with reference to FIGS. 5 and 6, its detailed description will be omitted.

For the external sensing period OS, the sixth switch SW6 is turned off by the sixth switch signal SCS6 of the second logic level voltage V2, the seventh switch SW7 is turned off by the seventh switch signal SCS7 of the second logic level voltages V2, and the eighth switch SW8 is turned off by the eighth switch signal SCS8 of the second logic level voltage V2. For this reason, each of the sensing units SU1 to SUp is not operated for the external sensing period OS.

As described above, in the embodiment of the present invention, since the sensing lines may be connected to one sensing data output unit by using the switching units in a predetermined order, the currents of the sensing lines may be sensed using one sensing data output unit and then output as the first sensing data. As a result, in the embodiment of the present invention, the problem that the difference between the first sensing data output from the sensing data output units occurs due to the difference in sensing capability between the sensing data output units may be solved, whereby sensing accuracy may be enhanced.

Also, in the embodiment of the present invention, each sensing data output unit is not provided inside each of the source drive ICs but provided in the source circuit board. As a result, in the embodiment of the present invention, since the sensing data output unit is not provided, circuit complexity of the source drive IC may be lowered, whereby the manufacturing cost of the source drive IC may be reduced. Also, in the embodiment of the present invention, since the sensing data output unit is provided in the source circuit board, there is no restriction in a circuit size of the sensing data output unit, whereby the first operation amplifier of the sensing data output unit may be used as a high performance operation amplifier. Therefore, in the embodiment of the present invention, sensing accuracy may be enhanced.

Also, in the embodiment of the present invention, the reference current supplied from the current supply source may be sensed to output reference data. As a result, in the embodiment of the present invention, if a plurality of sensing data output units are provided, the reference data output from the sensing data output units are compared with one another, whereby the difference in sensing capability between the respective sensing data output units may be compensated. As a result, in the embodiment of the present invention, the problem that the difference between the first sensing data output from the sensing data output units occurs due to the difference in sensing capability between the sensing data output units may be solved, whereby sensing accuracy may be enhanced.

Moreover, in the embodiment of the present invention, the sensing lines may be connected to one sensing data output unit in a predetermined order by using the switching unit, whereby the currents of the sensing lines may be sensed, using one sensing data output unit, to output the first sensing data. Also, the currents of the sensing lines may be sensed, using the sensing units included in the switching unit, to output the second sensing data. As a result, in the embodiment of the present invention, the first sensing data may be compared with the second sensing data, whereby the difference in sensing capability between the sensing units may be compensated. As a result, in the embodiment of the present invention, the problem that the difference between the second sensing data output from the sensing units occurs due to the difference in sensing capability between the sensing units may be solved, whereby sensing accuracy may be enhanced.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An organic light emitting display device, comprising:
- a display panel including data lines, scan lines, sensing lines, and pixels connected to the data lines, the scan lines and the sensing lines;
- a sensing data output circuit configured to output first sensing data by sensing currents flowing to the sensing lines;
- a scan driver supplying scan signals to the scan lines; and
- a source drive integrated circuit (IC) including a data voltage supply circuit supplying data voltages to the data lines and a switching circuit connecting the sensing lines to the sensing data output circuit in a predetermined order;
- a timing controller configured to control operation timings of the scan driver and the source drive IC; and
- a digital data compensation circuit configured to receive the first sensing data and an input video data, and to output a compensated data based on the first sensing data and the input video data,
- wherein the digital data compensation circuit is further configured to provide the compensated data to the timing controller in a display mode and a predetermined data to the timing controller in a sensing mode, and
- wherein the timing controller is further configured to provide the compensated data to the source drive IC in the display mode and the predetermined data to the source drive IC in the sensing mode.

2. The organic light emitting display device of claim 1, wherein the source drive IC includes first switches switched by respective first switch signals, each connecting a respective one of the sensing lines to the sensing data output circuit in the predetermined order.

3. The organic light emitting display device of claim 2, wherein each of the first switches is connected to the respective one of the sensing lines one to one.

4. The organic light emitting display device of claim 1, wherein the sensing data output circuit includes:
- a first current-to-voltage converter converting each current flowing to the sensing lines to a voltage and outputting the converted voltage; and
- a first analog-to-digital converter converting the voltage output from the first current-to-voltage converter to first sensing data corresponding to digital data.

5. The organic light emitting display device of claim 4, wherein the first current-to voltage converter includes:

a first operation amplifier having an inversion terminal connected to the switching unit, a non-inversion terminal to which an initialization voltage is supplied, and an output terminal connected to the first analog-to-digital converter;

a first feedback capacitor provided between the inversion terminal of the first operation amplifier and the output terminal;

a second switch switched in accordance with a second switch signal, connecting the inversion terminal and the output terminal of the first operation amplifier with each other;

a third switch switched in accordance with a third switch signal, connecting the output terminal of the first operation amplifier with a first sensing node; and a fourth switch switched in accordance with a fourth switch signal, connecting the first sensing node to the first analog-to-digital converter.

6. The organic light emitting display device of claim 5, wherein second and third switch signals of a first logic level voltage for turning on second and third switches are supplied for a first time period, the third switch signal of the first logic level voltage for turning on the third switch is supplied for a second time period, and a fourth switch signal of the first logic level voltage for turning on the fourth switch is supplied for a third time period.

7. The organic light emitting display device of claim 5, wherein the first current-to voltage converter further includes a fifth switch switched in accordance with a fifth switch signal, connecting the inversion terminal of the first operation amplifier to a current supply source to supply a reference current.

8. The organic light emitting display device of claim 1, wherein the switching circuit further includes a plurality of sensing circuits respectively connected to the sensing lines, each of the sensing circuits having a circuit size smaller than a circuit size of the sensing data output circuit and configured to output a second sensing data based on the current flowing to the respective one of the sensing lines.

9. The organic light emitting display device of claim 8, wherein each of the sensing circuits includes:

a second current-to-voltage converter converting the current flowing to the respective one of the sensing lines to a voltage and outputting the converted voltage; and a second analog-to-digital converter converting the voltage output from the second current-to-voltage converter to the second sensing data corresponding to digital data.

10. The organic light emitting display device of claim 9, wherein the second current-to-voltage converter includes:

a second operation amplifier having an inversion terminal connected to the sensing lines, a non-inversion terminal to which an initialization voltage is supplied, and an output terminal connected to the second analog-to-digital converter;

a second feedback capacitor provided between the inversion terminal of the second operation amplifier and the output terminal;

a sixth switch switched in accordance with a sixth switch signal, connecting the inversion terminal and the output terminal of the second operation amplifier with each other;

a seventh switch switched in accordance with a seventh switch signal, connecting the output terminal of the second operation amplifier with a second sensing node; and an eighth switch switched in accordance with an eighth switch signal, connecting the second sensing node to the second analog-to-digital converter.

11. The organic light emitting display device of claim 10, wherein sixth and seventh switch signals of a first logic level voltage for turning on sixth and seventh switches are supplied for a first time period, the seventh switch signal of the first logic level voltage for turning on the seventh switch is supplied for a second time period, and an eighth switch signal of the first logic level voltage for turning on the eighth switch is supplied for a third time period.

12. The organic light emitting display device of claim 1, further comprising:

a circuit board in which the sensing data output unit is provided; and a flexible film in which the source drive IC is provided, wherein the flexible film is attached to the display panel and the circuit board.

13. The organic light emitting display device of claim 1, wherein the pixel includes:

an organic light emitting diode;

a driving transistor controlling quantity of a current flowing to the organic light emitting diode in accordance with a voltage difference between a gate voltage and a source voltage;

a first transistor turned on by the scan signals of the scan lines, supplying the data voltage of the data lines to the gate electrode of the driving transistor;

a second transistor turned on by the sensing signals of the sensing signal lines, connecting the source electrode of the driving transistor with the sensing lines; and a capacitor provided between the gate electrode and the source electrode of the driving transistor.

14. The organic light emitting display device of claim 1, wherein the source drive IC further includes a plurality of initialization switches, each connected between an initialization voltage line and a respective one of the sensing lines and configured to provide an initialization voltage to the respective one of the sensing lines.

15. The organic light emitting display device of claim 2, further comprising a current supply source configured to output a reference current, wherein the sensing data output circuit is further configured to receive the reference current when each of the first switches is off.

16. A display device, comprising:

a display panel including data lines, scan lines, sensing lines, and pixels connected to the data lines, the scan lines, and the sensing lines;

a sensing data output circuit configured to output a first sensing data based on a current detected from the respective sensing lines connected to the sensing data output circuit;

a scan driver configured to supply scan signals to the scan lines;

a timing controller configured to output a plurality of first switch signals in a predetermined order; and a data driver including a plurality of first switches, each connected between the sensing data output circuit and a respective one of the sensing lines and configured to be turned on by a respective one of the first switch signals to connect the respective one of the sensing lines to the sensing data output circuit so that the sensing lines are connected to the sensing data output circuit in the predetermined order; and a digital data compensation circuit configured to receive the first sensing data and an input video data, and to output a compensated data based on the first sensing data and the input video data, wherein the digital data compensation circuit is further configured to provide the compensated data to the timing controller in a display mode and a predetermined data to the timing controller in a sensing mode, and wherein the timing controller is further configured to provide the compensated data to the data driver in the display mode and the predetermined data to the data driver in the sensing mode.

17. The display device of claim 16, wherein the data driver further includes a plurality of initialization switches, each connected between an initialization voltage line and a respective one of the sensing lines, and wherein the timing controller is further configured to provide an initialization signal to switch the initialization switches on to provide an initialization voltage to the sensing lines.

18. The display device of claim 16, wherein the data driver is further configured to provide data voltages to the data lines based on the compensated data.

19. The display device of claim 16, wherein the data driver further includes a plurality of sensing circuits respectively connected to the sensing lines, and configured to detect the current from the sensing lines and to output a second sensing data based on the detected current.

20. The display device of claim 19, further comprising a digital data compensation circuit configured to receive the first sensing data, the second sensing data, and an input video data, and to output a compensated data based on the first sensing data, the second sensing data, and the input video data, wherein the data driver is further configured to provide data voltages to the data lines based on the compensated data.

21. The display device of claim 16, further comprising a current supply source configured to output a reference current, wherein the sensing data output circuit is further configured to receive the reference current when each of the first switches is off.

* * * * *